US005820032A

United States Patent [19]

Reiter

[11] Patent Number: 5,820,032

[45] Date of Patent: Oct. 13, 1998

[54] ELECTROMAGNETICALLY ACTIVATED VALVE, PARTICULARLY A FUEL INJECTION VALVE

[75] Inventor: Ferdinand Reiter, Markgröningen, Germany

[73] Assignee: Robert Bosch GmbH, Stuttgart, Germany

[21] Appl. No.: 817,457

[22] PCT Filed: Jun. 27, 1996

[86] PCT No.: PCT/DE96/01136

§ 371 Date: Apr. 15, 1997

§ 102(e) Date: Apr. 15, 1997

[87] PCT Pub. No.: WO97/13977

PCT Pub. Date: Apr. 18, 1997

[30] Foreign Application Priority Data

Oct. 7, 1995 [DE] Germany ..... 195 37 382.0

[51] Int. Cl.[6] ..... F02M 51/06

[52] U.S. Cl. ..... 239/585.1; 239/900

[58] Field of Search ..... 239/585.1, 900; 251/129.18, 129.2, 129.21; 123/472

[56] References Cited

U.S. PATENT DOCUMENTS

| | | | |
|---|---|---|---|
| 4,264,040 | 4/1981 | Saito | 239/900 X |
| 4,308,890 | 1/1982 | Saito | 137/495 |
| 4,434,765 | 3/1984 | Eshelman | 239/900 X |

FOREIGN PATENT DOCUMENTS

| | | | |
|---|---|---|---|
| 0006769 | 1/1980 | European Pat. Off. | 239/585.1 |
| 007724 | 2/1980 | European Pat. Off. . | |
| 063952 | 11/1982 | European Pat. Off. . | |
| 56-75955 | 6/1981 | Japan . | |
| 2033004 | 5/1980 | United Kingdom | 239/900 |

*Primary Examiner*—Lesley D. Morris
*Attorney, Agent, or Firm*—Kenyon & Kenyon

[57] ABSTRACT

An electromagnetically activated valve possesses an electromagnetic circuit, formed by, among other things, a magnetic coil, a magnet housing, and a core which serves as the inner pole. A valve element which serves as the anchor and closing element is spherical in structure, and moves axially within the magnet housing. A contact element is arranged between the core and the valve element, and has a contact surface with a spherical curve, facing the valve element. The valve element is surrounded by a guide element at least in part in the circumference direction, which element has a guide opening which also has a spherical curve, at least in part. The valve, in the form of a fuel injection valve, is particularly suitable for use in fuel injection systems for mixture-compressing, outside-ignition internal combustion engines.

14 Claims, 2 Drawing Sheets

ELECTROMAGNETICALLY ACTIVATED VALVE, PARTICULARLY A FUEL INJECTION VALVE

BACKGROUND OF THE INVENTION

A fuel injection valve is described in European Patent No. EP-OS 0 007 724, which has a spherical valve element which can move axially in the valve and likewise serves as the valve closing element. The spherical valve element acts together with a fixed, non-magnetic valve seat, where the one end position of the valve element is fixed in that the valve element rests against the valve seat, when the magnetic coil is not excited. A magnetic inner pole lies exactly opposite the valve seat, with reference to the valve element. When the electromagnetic circuit is excited, the spherical valve element is pulled towards the inner pole, causing it to directly touch a contact surface of the inner pole. The valve is now open. The valve element is surrounded by a magnetic side pole, which represents a magnetic disk with a cylindrical opening. The magnetic field lines run from the side pole to the inner pole via the valve element, where a large radial air gap occurs between the side pole and the valve element, which gap results from the geometry of the cylindrical opening. A further disadvantage consists of the difficulty in handling the inner pole when structuring the contact surface. In forming and applying a surface treatment (coating) to this contact surface, the entire inner pole always has to be handled.

U.S. Pat. No. 4,308,890 describes a similar electromagnetically activated injection valve, which also possesses a spherical valve element. The two end positions of the axial movement of the valve element are again determined by a contact surface on a magnetic inner pole and a fixed valve seat. There is no guidance of the valve element during its axial movement between the two end positions. A ring region projects out from a magnet housing, in the region of the axial expanse of the valve element, up to the vicinity of the valve element. The ring region defines an inner, cylindrical opening region, through which the valve element moves. Here again, there is a large radial air gap between the valve element and the ring region which acts as a side pole. The same disadvantages mentioned above also exist for the electromagnetically activated fluid injection valve known from EP-PS 0 063 952.

SUMMARY OF THE INVENTION

The electromagnetically activated valve according to the present invention, particularly a fuel injection valve, has the advantage that a high level of effectiveness of the magnetic circuit is achieved in a simple and cost-effective manner, since the losses of the magnetic field can be kept very low on the basis of simple design measures.

A soft-magnetic guide element according to the present invention, surrounding a spherical valve element, because of its partial formation as a spherical curve in the region of an inner guide opening, ensures both good guidance of the valve element and an optimum transition of the magnetic field lines to the valve element, because a radial air gap formed between the two can be kept to a minimum.

It is furthermore advantageous that handling of some components of the valve during certain production processes, for example surface treatments, is clearly simplified. A contact element arranged between a core which serves as the inner pole and the spherical valve element can be very easily shaped, as a separate insertion part, can easily be subjected to surface treatment (e.g. coating), and is also easy to install. It is advantageous to make the contact element in the shape of a disk, and to have it pressed against the core by means of a pressure spring, where the guidance of the contact element is provided by means of a non-magnetic intermediate piece.

A particular advantage consists of making the contact element as a large-pore sintered element. The contact element is then sintered from beads which have a diameter in the range of tenths of a millimeter. A fluid can still flow well between the beads which have been sintered together, so that no additional flow channels are necessary. In addition to the simple geometry and ease of production, the large pores result in the advantage that hydraulic sticking in the region of the contact surface is prevented. The contact element simultaneously acts as a filter which keeps coarse dirt out of the seat region.

Furthermore, it is advantageous if the contact surface of the contact element, which has a spherical curve shape, does not exactly correspond to the surface contour, i.e. the radius of the spherical valve element. Then there will only be ring-shaped linear contact when contact occurs.

DETAILED DESCRIPTION

Description of the Exemplary Embodiments

Figure 1:
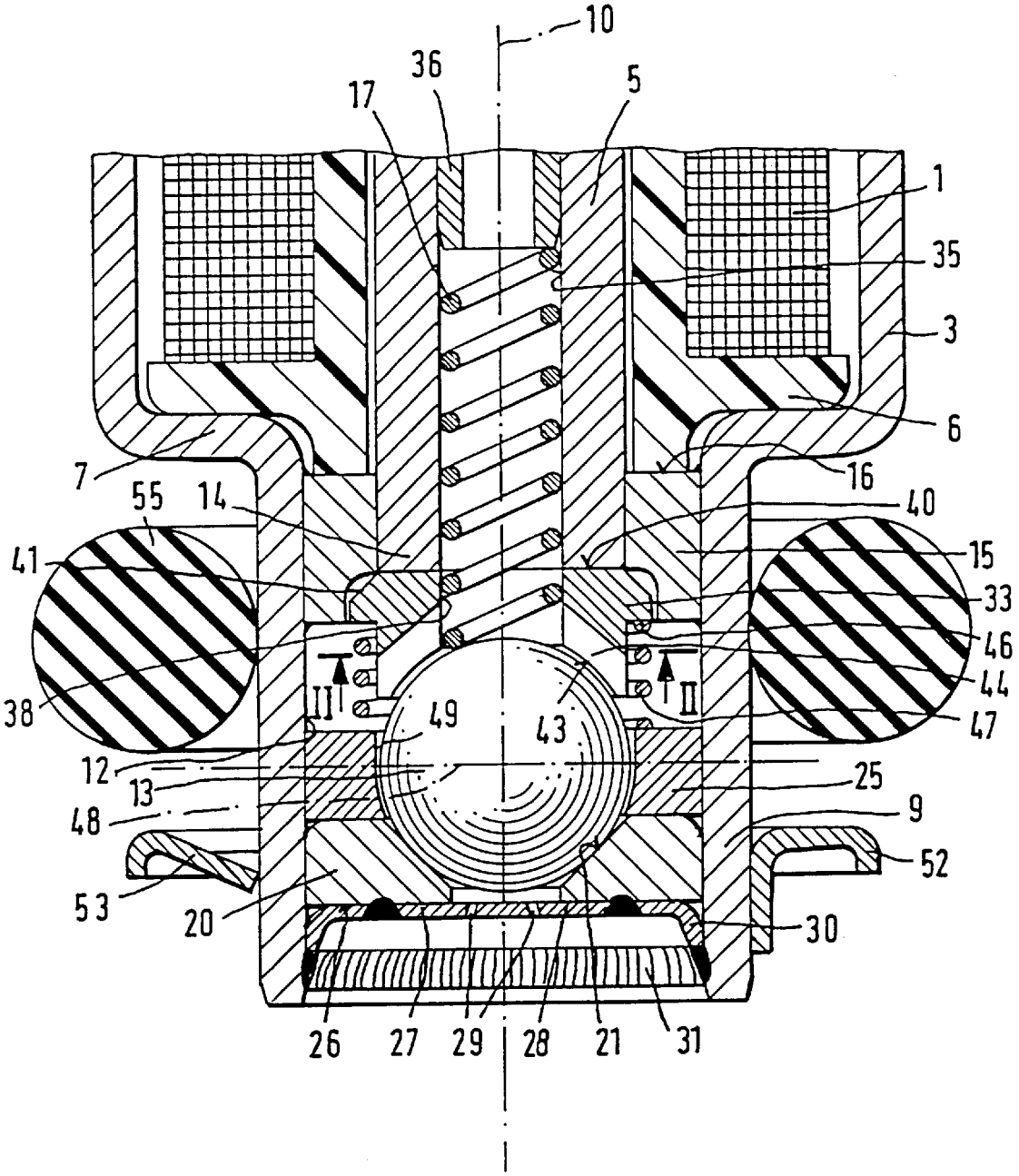
FIG. 1 shows an electromagnetically activated valve according to the present invention, shown in part.

The electromagnetically activated valve shown as an example in FIG. 1, shown only in part, in the form of an injection valve for fuel injection systems for mixture-compressing, outside ignition internal combustion engines, has an electromagnetic circuit with, among other things, a magnetic coil 1, a stepped, tube-shaped magnet housing 3, and a core 5 which serves as an inner pole and a fuel inlet tap, which has a constant diameter over its entire length, for example. A coil element 6, which is stepped, for example, holds a winding of the magnetic coil 1 and allows a particularly compact structure of the injection valve in the region of the magnetic coil 1.

The magnetic coil 1 is embedded in the stepped magnet housing 3 with its coil element 6 in a certain way, i.e. it is completely surrounded by the magnet housing 3 in the circumference direction, and at least partially surrounded towards the bottom. A lid element, not shown, which can be set into the magnet housing 3, ensures that the magnetic coil 1 is covered towards the top, and serves to close the magnetic circuit. The lid element therefore connects the core 5 with the magnet housing 3, above the magnetic coil 1. By means of a step 7 in the magnet housing 3, directly below the coil element 6, a reduction in the diameter of the magnet housing 3 occurs, seen in the downstream direction, and the housing also acts as a valve seat carrier with its downstream end region 9, among other things. The coil element 6 rests on the step 7 of the magnet housing 3, for example.

In this connection, the tube-shaped magnet housing 3 extends concentric to a longitudinal valve axis 10. In the magnet housing 3, there is a lengthwise bore 12, which is also formed concentric to the longitudinal valve axis 10. In the lengthwise bore 12, a spherical valve element 13 is arranged, which represents both the anchor and the valve closing element of the injection valve. A tube-shaped, metallic, non-magnetic intermediate part 15 is connected with a bottom core end 14 of the core 5, for example by soldering, and surrounds the core end 14 axially, at least in part. Since a leak-proof and solid connection between the intermediate part 15 and the magnet housing 3 also guarantees a tight seal between the core 5 and the magnet housing 3, the magnetic coil 1 is dry. In this connection, the coil element 6 rests against a top face 16 of the intermediate part 15, for example.

Activation of the injection valve takes place electromagnetically, in a known manner. For an axial movement of the valve element 13, and therefore to open the injection valve counter to the spring force of a return spring 17 which rests against the valve element 13, or to close it, the electromagnetic circuit with the magnetic coil 1, the magnet housing 3, and the core 5 is used. In the end region 9 of the magnet housing 3 which is located downstream, facing away from the magnetic coil 1, a cylinder-shaped valve seat element 20, which has a fixed valve seat 21, is installed and fixed in place in the lengthwise bore 12, for example by welding.

To guide the valve element 13 during its axial movement along the longitudinal valve axis 10, a disk-shaped guide element 25 is used. The spherical valve element 13 acts together with the valve seat 21 of the valve seat element 20, which valve seat narrows in truncated cone shape in the flow direction. The circumference of the valve seat element 20 has a slightly smaller diameter than the lengthwise bore 12 of the magnet housing 3. At its face 26 facing away from the valve element 13, the valve seat element 20 is connected with an injection hole disk 27, which is formed in the shape of a pot, for example, and the connection is formed by a continuous, leak-proof weld seam produced by means of a laser, for example.

The pot-shaped injection hole disk 27 possesses not only a base part 28, on which the valve seat element 20 is attached, and in which there is at least one injection opening 29, or, for example, four such openings, produced by means of erosion or punching, but also a continuous holder edge 30 which is directed downstream. Direct flow of the fluid, particularly of the fuel into a suction intake line of the internal combustion engine, outside of the injection openings 29, is prevented by means of a weld seam 31 between the injection hole disk 27 and the magnet housing 3.

The insertion depth of the valve seat element 20 with the pot-shaped injection hole disk 27, i.e. the arrangement of a disk-shaped contact element 33 upstream from the valve element 13, determines the size of the stroke of the valve element 13. In this connection, one end position of the valve element 13, when the magnetic coil 1 is not excited, is determined by contact of the valve element 13 against the valve seat 21 of the valve seat element 20, while the other end position of the valve element 13, when the magnetic coil 1 is excited, results from its contact against the contact element 33.

An adjustment sleeve 36 inserted into a flow bore 35 of the core 5 which runs concentric to the longitudinal valve axis 10, which sleeve is formed, for example, from rolled spring steel sheet, serves to adjust the spring tension of the return spring 17 which runs in the flow bore 35 and rests against the adjustment sleeve 36, which spring in turn rests against the surface of the spherical valve element 13 with its opposite side. The return spring 17 also projects through the contact element 33 in a continuous inner opening 38, which has a diameter, for example, which exactly corresponds to the diameter of the flow bore 35 of the core 5. Therefore the opening 38 represents a continuation of the flow bore 35.

Figure 3:
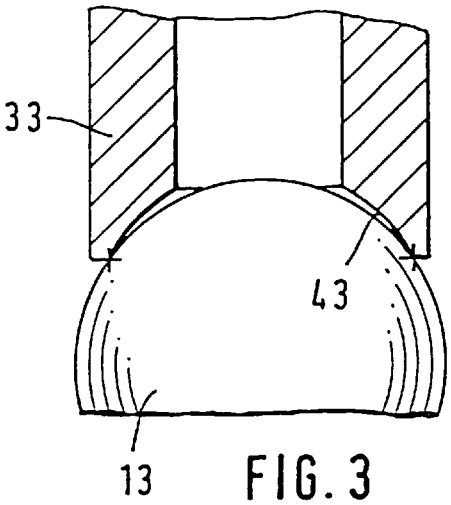
FIG. 3 shows the contact of a valve element against the contact element in an outside region.
Figure 4:
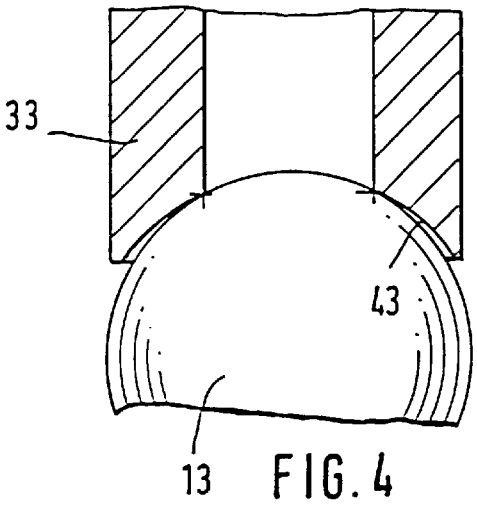
FIG. 4 shows the contact of a valve element against the contact element in an inside region.
Figure 5:
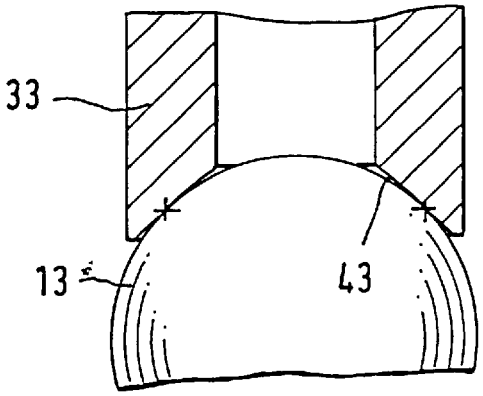
FIG. 5 shows the contact of a valve element against the contact element in a center region.

The contact element 33 rests against the core end 14 of the core 5 with a top face 40. In this connection, the face 40 is finished in such a way, for example, that the contact element 33 exclusively touches the core 5, and not the intermediate part 15. In order to achieve this, a continuous bevel 41 is provided on the outer circumference of the contact element 33, 5 for example. In the circumference direction, the contact element 33 is otherwise guided by the intermediate part 15. While the top face 40 of the contact element 33 is made to be flat, the opposite, bottom contact surface 43, which faces the valve element 13, is formed with a spherical curve, in order to make the magnetic circuit as effective as possible, by keeping any air gaps small. Various possibilities of forming the spherical curve geometry of the contact element 33 are shown in FIGS. 3 to 5, which will be explained in greater detail below. The contact surface 43, with a spherical curve, is interrupted by at least one, for example by four fluid passages which run radially and, at the same time, downstream, particularly fuel passages 44. In this connection, the at least one fuel passage 44 is made in the contact element 33 in the form of a groove.

The contact element 33 possesses a stepped outside contour, where a top region has a greater outside diameter than a bottom region which contains the fuel passages 44. This results in a step 46 on the contact element 33, against which a pressure spring 47 presses. While the pressure spring 47 which rests against the contact element 33 presses the contact element 33 against the core end 14 of the core 5, it rests against the guide element 25 with its opposite side, and this guide element in turn rests on the valve seat element 20. The contact element 33 consists of soft-magnetic material and is surface-treated, e.g. chrome-plated, at least at the bottom contact surface 43 with a spherical curve, for reasons of friction wear protection.

The spherical valve element 13 possesses a sphere equator 48 which lies in a plane of the sphere which divides the sphere into two spherical halves of equal size. The disk-shaped guide element 25, which has a guide opening 49 through which the valve element 13 moves, extends in the region of this sphere equator 48. The guide element 25 is made of a soft-magnetic material and shaped with a spherical curve, corresponding to the contour of the valve element 13, at least proceeding from the axial height of the sphere equator 48, when the valve seat 21 rests against the valve element 13, in the downstream direction. The magnetic flow passes via the magnet housing 3, the guide element 25, the valve element 13, and the contact element 33, to the core 5. By means of the spherical curve shape of the guide opening 49 on the guide element 25, the magnetic flow can pass over to the valve element 13 with a minimum radial air gap. The top part of the guide opening 49 is cylindrical, for example. The guide element 25 can also be installed in such a way, rotated by 1800, that the segment of the guide opening 49 with the spherical curve shape lies above the sphere equator 48. For fluid feed in the direction of the valve seat 21, groove-like depressions in the guide opening 49 of the guide element 25, running axially, can be provided. The guide element 25 can be produced, for example, by means of stamping, sintering, or the MIM (metal injection molding) technique.

The contact element 33 can also be produced by means of stamping, sintering, or the MIM technique. As an alternative, the contact element 33 can be sintered from beads which have a diameter in the range of tenths of a millimeter. In the case of such a coarse-pore sintered element, the fluid passages, particularly fuel passages 44, are no longer necessary, since the fuel can flow between the beads which have been sintered together. Because of the large-pore surface of the contact element 33, hydraulic sticking can be effectively prevented. The contact element 33 also acts as a filter which keeps dirt away from the seat region.

A holder ring 52 made of sheet metal, for example, is mounted on the end region 9 of the magnet housing 3. This continuous holder ring 52, which is hook-shaped in profile, possesses tabs 53 which project out at three or four points of the circumference, which prevent the holder ring 52 from being stripped off during disassembly of the injection valve, by means of self-locking. A ring groove is formed on the outer circumference of the magnet housing 3 by means of the step 7 of the magnet housing 3 and the holder ring 52, and a sealing ring 55 is arranged in this groove.

Figure 2:
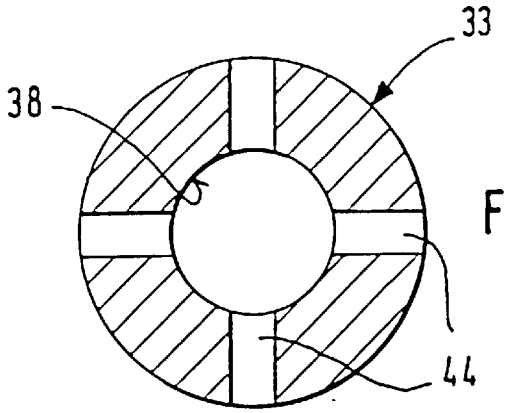
FIG. 2 shows a cross-section along the line II—II in figures through a contact element.

FIG. 2 is a cross-sectional view of the contact element 33 along the line II—II in FIG. 1. In this exemplary embodiment, four groove-shaped fuel passages 44, each arranged at a distance of 45° from each other, are provided, which run from the inner opening 38 radially outward. A different number of fuel passages 44 is also possible. The fuel passages 44 can be eliminated entirely, if the contact element 33 is formed as a coarse-pore sintered element.

In order to prevent hydraulic sticking, the geometry of the contact surface 43 of the contact element 33, which has a spherical curve, should not precisely correspond to the surface contour, i.e. the radius of the spherical valve element 13. FIGS. 3, 4, and 5 show possible contours to avoid hydraulic sticking. For example, the valve element 13 can touch the contact surface 43 of the contact element 33 only in an outside region (FIG. 3), only in an inside region (FIG. 4), or only in a center region (FIG. 5), while the 6ther regions of the contact surface 43 in each instance extend away from the valve element 13 at a very slight distance. Therefore the linear contact is only ring-shaped in each instance, to a great extent.

What is claimed is:

1. An electromagnetically activated valve having a longitudinal valve axis, comprising:

a valve seat, at least one injection opening being disposed downstream from the valve seat;

a spherical valve element adapted to be moved axially along the longitudinal valve axis, the valve element resting on the valve seat in one end position of the axial movement of the valve element, the valve element having a sphere equator running perpendicular to the longitudinal valve axis;

a core representing an inner pole of an electromagnetic circuit, the core lying opposite the valve seat with respect to the valve element; and a guide element having a guide opening, the guide element extending in a plane, the sphere equator running in the plane, the valve element adapted to be moved axially in the guide opening, at least a portion of the guide opening having a spherical curve shape.

2. The valve according to claim 1, wherein the valve is a fuel injection valve of a fuel injection system of an internal combustion engine.

3. The valve according to claim 1, wherein the guide opening has a cylindrical segment adjacent to a narrowing segment with a spherical curve contour.

4. The valve according to claim 3, wherein the narrowing segment follows the cylindrical segment, facing the valve seat.

5. The valve according to claim 3, wherein the narrowing segment follows the cylindrical segment, facing the core.

6. The valve according to claim 1, wherein at least one groove-like depression is disposed on the guide opening.

7. The valve according to claim 1, wherein the valve seat is arranged on a valve seat element, and the guide element rests on the valve seat element.

8. The valve according to claim 1, further comprising a contact element arranged between the core and the valve element, the contact element having a contact surface with a spherical curve facing the valve element, the valve element resting on the contact surface in another end position of the axial movement of the valve element.

9. The valve according to claim 8, wherein the contact element is disk-shaped and has an axially-running inner opening.

10. The valve according to claim 8, wherein the contact element has an outside contour and has a step on the outside contour, the step reducing an outside diameter in a downstream direction, and further comprising a pressure spring resting against the step and pressing the contact element against the co re, the pressure spring resting, on an opposite side, against the guide element.

11. The valve according to claim 9, wherein the contact element has at least one fluid passage, the fluid passage guaranteeing a fluid flow from the inner opening, proceeding in a direction of the valve seat.

12. The valve according to claim 11, wherein the at least one fluid passage runs radially as a groove in the contact surface of the contact element, facing the valve element.

13. The valve according to claim 8, wherein the contact element includes a coarse-pore sintered element through which a fluid flows.

14. The valve according to claim 8, wherein the valve element rests, in the one end position, against only a small region of the contact surface of the contact element, forming a substantially ring-shaped linear contact.

* * * * *

UNITED STATES PATENT AND TRADEMARK OFFICE

CERTIFICATE OF CORRECTION

PATENT NO. : 5,820,032

DATED : October 13, 1998

INVENTOR(S) : REITER, F.

It is certified that error appears in the above-identified patent and that said Letters Patent is hereby corrected as shown below:

Column 2, line 27, change "in figures" to --(in Figure 1)--;

Column 2, line 36, delete "Description of the Exemplary Embodiments";

Column 4, line 58, change "1800" to --180°--; and

Column 5, line 37, change "6ther" to --other--.

Signed and Sealed this

Seventeenth Day of August, 1999

*Attest:*

Q. TODD DICKINSON

*Attesting Officer*

*Acting Commissioner of Patents and Trademarks*